US006161957A

United States Patent [19]

Guanter

[11] Patent Number: 6,161,957

[45] Date of Patent: Dec. 19, 2000

[54] BALLISTIC EFFECT DATA SELECTION METHOD, INTENDED TO BE IMPLEMENTED IN ELECTRONIC DEVICES, IN PARTICULAR IN ELECTRONIC TIMEPIECES

[75] Inventor: Jean-Charles Guanter, Diesse, Switzerland

[73] Assignee: Asulab, S.A., Bienne, Switzerland

[21] Appl. No.: 09/127,689

[22] Filed: Jul. 31, 1998

[30] Foreign Application Priority Data

Jul. 31, 1997 [CH] Switzerland ..... 1839/97

[51] Int. Cl.[7] ..... G04B 18/00

[52] U.S. Cl. ..... 368/185; 368/69

[58] Field of Search ..... 368/185, 190–195, 368/69, 70

[56] References Cited

U.S. PATENT DOCUMENTS 5,946,274 8/1999 Yamaguchi et al. ..... 368/67

FOREIGN PATENT DOCUMENTS 0069693 3/1990 Japan ..... 368/208

*Primary Examiner*—Bernard Roskoski

*Attorney, Agent, or Firm*—Sughrue, Mion, Zinn, Macpeak & Seas, PLLC

[57] ABSTRACT

The present invention concerns a method for selecting at least one item of data from a set of data regrouped in accordance with a predetermined order. This method is able to be implemented in an electronic device including means for displaying the selected item of data, input means for supplying, via the action of a user of the device, a direction and successive pulses, means for controlling the display means in a non-instantaneous manner, and a processing unit for the set of data. This method is characterised in that it includes a first step which consists in counting the number of pulses provided, via the action of the user, during the period of time in which said display means is being activated to reach said selected item of data, in order to determine the acceleration provided by said user to said input means during this period of time.

15 Claims, 9 Drawing Sheets

BALLISTIC EFFECT DATA SELECTION METHOD, INTENDED TO BE IMPLEMENTED IN ELECTRONIC DEVICES, IN PARTICULAR IN ELECTRONIC TIMEPIECES

BACKGROUND OF THE INVENTION

The present invention concerns the field of data selection methods able to be implemented in electronic devices, in particular in electronic timepieces.

In a conventional electronic timepiece, one of the most commonly used devices for selecting data comprises the rotation of a crown. There exist in the prior art a good number of data selection devices, intended to be used in timepieces comprising a crown.

With reference to FIG. 1A of the present description, European Patent Document No. EP-A-0 064 023 discloses a timepiece of the aforementioned type made in the form of a wristwatch 1 including a minute hand 2, an hour hand 3, a stepping motor (not shown) for driving said hands, and a winding button or crown 4 fixed to the end of a winding-stem. The crown can take two different axial positions, a rest position i.e. a reference position, and a working position i.e. a pulled out position with respect to the reference position. Swiss Patent No. 643 427 discloses in more detail such a winding-stem and crown arrangement (hereinafter called a stem-crown) which is used as a switching device. Moreover, wristwatch 1 includes a memory (not shown) for storing data, and a liquid crystal display cell 5 for displaying one item of such data.

When a user of wristwatch 1 pulls stem-crop 4 into its working position, and drives it in rotation, data appear on display 5, the speed and the scrolling direction of such data depending respectively upon the speed and direction of rotation of the crown. The user can thus select data from all the data stored in wristwatch 1, in particular for correcting the displayed time.

Other types of timepieces whose arrangement allows data selection exist in the prior art.

With reference to FIG. 1B of the present description, European Patent Document No. EP 0 031 077 discloses a data input device for a timepiece 10. This timepiece includes a case 11 in which are arranged an electronic module whose display 12 can be seen, several push-buttons 13 to 17 and a sensor 20 formed of four identical juxtaposed electrodes 21. Display 12 permanently displays the hour indication 24 and the minute indication 25.

In order to correct hour indication 24 (or minute indication 25), the user moves his finger on sensor 20 at a speed which must be lower (or respectively higher) than a threshold speed.

Generally, the Applicant of the present invention has observed that the conventional data selection methods relating to timepieces such as those described hereinbefore, provide a data scrolling speed which is connected to the instantaneous value of the speed provided by the user, this latter being for example the rotational speed of stem-crown 4 for wristwatch 1 of FIG. 1A, or the speed of movement of the user's finger on sensor 20 for timepiece 10 of FIG. 1B.

A drawback of such methods lies in the fact that the user must provide a high speed to achieve a rapid change in the data displayed, which makes data selection difficult.

Another drawback of these methods lies in the fact that it is more comfortable to remove the wristwatch from the wrist before performing a rapid change of data, typically to change time zone, which is contrary to the usual concerns of ease of use.

SUMMARY OF THE INVENTION

An object of the present invention is to provide a data selection method, intended to be implemented in an electronic device containing a set of data, in particular in an electronic timepiece, this method overcoming the drawbacks described hereinbefore, in particular allowing a rapid change of data.

Another object of the present invention is to provide a data selection method capable of being adapted to a large number of applications.

Another object of the present invention is to provide a data selection method intended to be implemented in an electronic timepiece, this method allowing a change of time zone to be performed, while maintaining the minute display.

These objects, in addition to others, are achieved by the data selection method according to appended claims.

As a result of the features of such a data selection method, one advantage of counting the pulses supplied, via the action of the user, during a period of time corresponding to the duration of the current activation of the control means, is to allow the total number of pulses supplied during this time period to be calculated, the speed provided by the user being able to vary between the beginning and the end of such time period. In other words, the number of pulses counted is connected to the acceleration provided by the user during the time period in which the display is being activated, contrary to the aforementioned conventional methods.

As a result of other features of such a data selection method, one advantage of its being intended for an electronic timepiece including memory means containing a set of data is to enable any set of sequence data to be stored, which allows this method to be adapted to a large number of applications.

As a result of other features of such a data selection method, one advantage of its being intended for an electronic timepiece including counting means is to enable a number of steps representing the activation of the control means to be provided, which allows a time zone change to be achieved, while maintaining the minute display.

These objects, features and advantages of the present invention, in addition to others, will appear more clearly upon reading the detailed description of a preferred embodiment of the invention, given solely by way of example, with reference to the annexed drawings, in which:

DESCRIPTION OF PREFERRED EMBODIMENTS

Figure 1A:
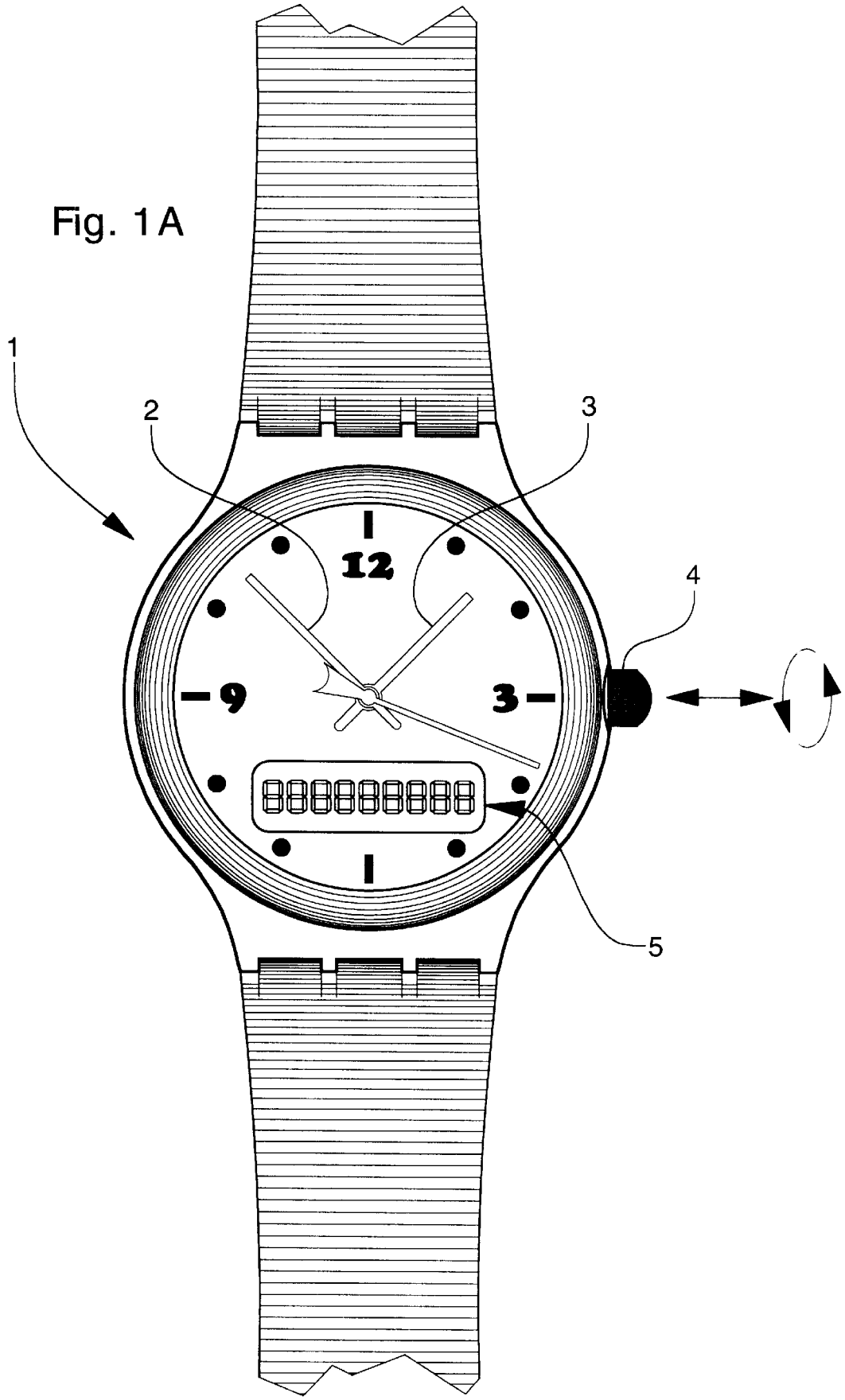
FIGS. 1A and 1B already cited show respectively first and second conventional timepieces.
Figure 1B:
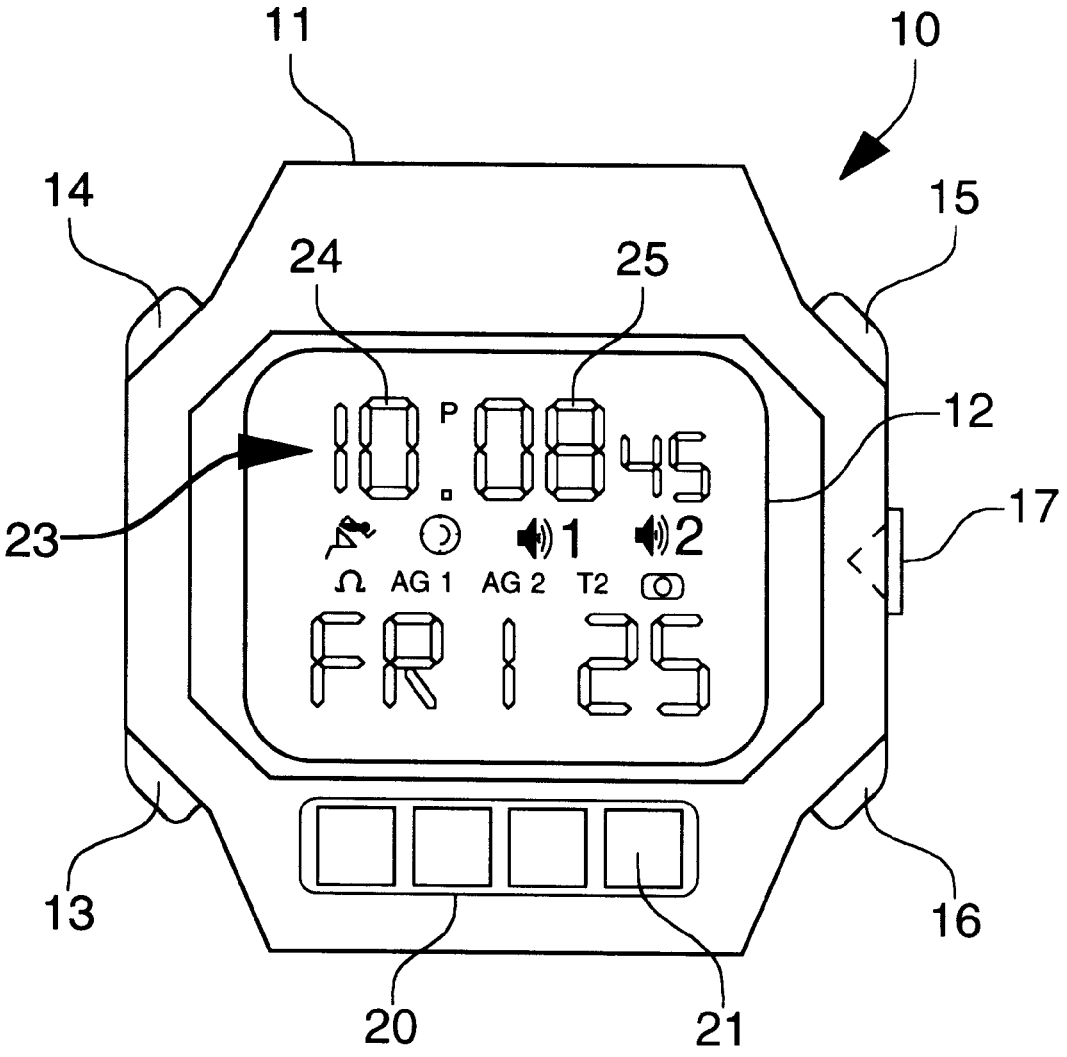
Figure 2:
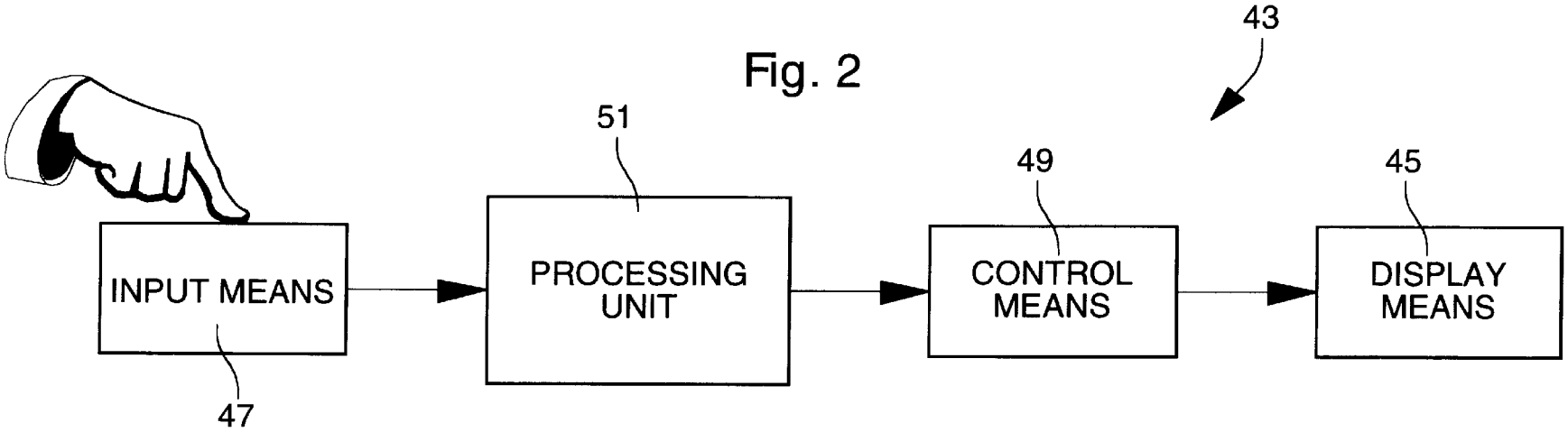
FIG. 2 shows a block diagram of a preferred implementation of a data selection method according to the present invention.

FIG. 2 shows a block diagram of a preferred implementation of a data selection method according to the present invention.

Such a data selection method is able to select at least one item of data from a set of data ordered in accordance with a predetermined order, such data being regrouped in sub-sets ordered in accordance with the predetermined order, two successive items of data being separated by one step.

This method is intended to be implemented in an electronic device 43 including display means 45, input means 47, control means 49 and a data processing unit 51.

Display means 45 are arranged so that they can display at least the selected item of data.

Input means 47 are arranged so that they can provide, via the action of a user of electronic device 43, an upward or downward direction, and can provide pulses, again via the action of said user. These means are also arranged so that they can count successive pulses, add them to a previously counted number of pulses, and store the result of this operation as a number of pulses.

Control means 49 are connected to display means 45, and are arranged so that they can receive the number of pulses, and drive, in a non-instantaneous manner, display means 45 for displaying the selected item of data. The non-instantaneous manner should be understood by the fact that the period of time necessary for driving display means 45 is proportional to the number of pulses received by control means 49, in other words this period of time varies as a function of this number of pulses.

Processing unit 51 is connected between the input means and the control means. The processing unit is arranged so as to be able to receive the number of pulses and the direction, and to store this number of pulses and direction as a scrolling direction, so that an upward direction corresponds to a scrolling direction in accordance with the predetermined order, and vice versa. It is also arranged so that it can store a change of direction indicator able to be set at <<1>> or at <<0>>, a predetermined number of pulses, and a predetermined number of steps.

Figure 3:
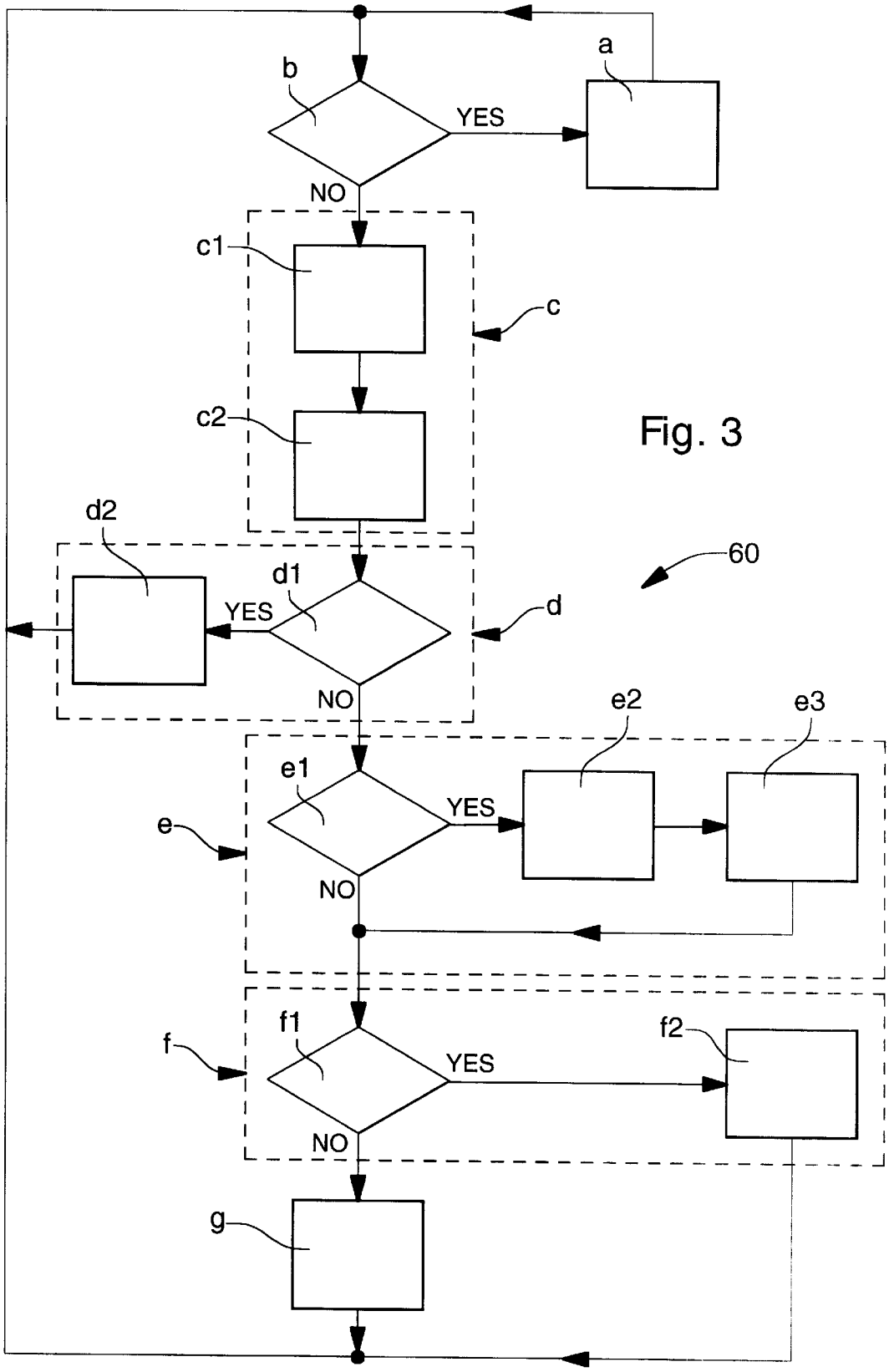
FIG. 3 shows a flow chart of the data selection method implemented in FIG. 2.

FIG. 3 shows a flow chart 60 of a data selection method according to the present invention, FIG. 2 showing a preferred implementation of this method.

Such a data selection method includes a first step designated <<a >> which consists in counting the number of pulses provided, via the action of the user, during a time period in which display means 45 is being activated to reach the selected item of data, in order to determine the acceleration provided by the user to the input means during said time period.

This selection method further includes the steps designated <<b>> to <<g>> which follow.

Step <<b>> consists in testing whether the control means are being activated. If the control means are being activated, step <<a>> is repeated, then step <<b>>. If the control means are not being activated, step <<b>> is followed by step <<c >>.

Step <<c>> includes two sub-steps designated respectively <<c1>> and <<c2 >>. Sub-step <<c1>> consists in transferring the number of pulses stored in the input means into the processing unit, and storing them therein as a number of pulses. Sub-step <<c1>> is followed by sub-step <<c2 >> which consists in setting the number of pulses stored in the input means at <<0>>.

Step <<d>> includes two sub-steps designated respectively <<d1>> and <<d2>>. Sub-step <<d1>> consists in testing whether the number of pulses stored in the processing unit in accordance with step <<c1>> is equal to <<0>>. If this number is equal to <<0>>, sub-step <<d1>> is followed by sub-step <<d2>> which consists in setting the change of direction indicator in the processing unit to <<1>>, and repeating step <<b>>. If the number of pulses stored in the processing unit according to step <<c1>> is not equal to <<0>>, sub-step <<d1>> is followed by step <<e>>.

Step <<e>> includes three sub-steps respectively designated <<e1>>, <<e2>> and <<e3>>. Sub-step <<e1>> consists in testing whether the change of direction indicator is equal to <<1>>.

If the change of direction indicator is equal to <<1>>, sub-step <<e1>> is followed by sub-step <<e2>> which consists of transferring the direction stored in the input means into the processing unit, and storing it in the processing unit as a scrolling direction. Sub-step <<e2>> is followed by sub-step <<e3>> which consists in setting the change of direction indicator stored in the processing unit at <<0>>.

If the change of direction indicator is not equal to <<1>>, sub-step <<e1>> is followed by step <<f>>.

Step <<f>> includes two sub-steps respectively designated <<f1>> and <<f2>>. Sub-step <<f1>> consists in testing whether the number of pulses stored in the processing unit is less than the predetermined number of pulses.

If the number of pulses stored in the processing unit is less than the predetermined number of pulses, sub-step <<f1>> is followed by sub-step <<f2>> which consists in supplying the number of pulses stored in the processing unit and the scrolling direction to the control means, in order to drive the display means to display the selected item of data, so that the number of steps effected in this scrolling direction during said display change corresponds to the number of pulses stored in the processing unit, then step <<b>> is repeated.

If the number of pulses stored in the processing unit is not less than the predetermined number of pulses, sub-step <<f1>> is followed by step <<g>>.

Step <<g>> consists in providing the predetermined number of steps and the scrolling direction stored in the processing unit to the control means, in order to drive the display means to display the first item of data from the sub-set which, according to this scrolling direction, follows the presently displayed item of data, then step <<b>> is repeated.

By way of implementation alternative, processing unit 51 can further include memory means arranged so that they can receive and store the set of data.

By way of example, the data selection method according to the present invention can be implemented in an electronic telephone directory. In such case, said data to be selected are, for example, surnames associated with telephone numbers, each of said sub-sets regrouping the totality of names beginning with the same letter, and said predetermined order being that of the alphabet.

Also by way of example, the data selection method according to the present invention can be implemented in an electronic translating device. In such case, said data to be selected correspond to common nouns associated with meanings, each of said sub-sets regrouping the totality of nouns beginning with the same letter, and said predetermined order being that of the alphabet.

Also by way of example, the data selection method according to the present invention may be implemented in an electronic diary. In such case, said data to be selected correspond to days associated with events, each of said sub-sets corresponding to one of the months of a year, and said predetermined order being that of the passage time.

Also by way of implementation alternative, the data selection method according to the present invention can be implemented in an analog electronic timepiece including a data processing unit, a stem-crown, a dial, an hour hand, a minute hand, and a stepping motor. It goes without saying that these different components are given only by way of illustration, and that they can also be replaced by components having similar functions.

Those skilled in the art will note that a data selection method according to the present invention can advantageously be implemented in a large number of electronic timepieces. The mechanical structure of the timepiece in which this method is implemented is substantially identical to that of an electronic timepiece according to the prior art.

Within the scope of such an horological application, said data to be selected correspond to the minutes of an hour, each of said sub-sets correspond to one of the hours of the day, and said predetermined order is that of the passage of time.

Figure 4:
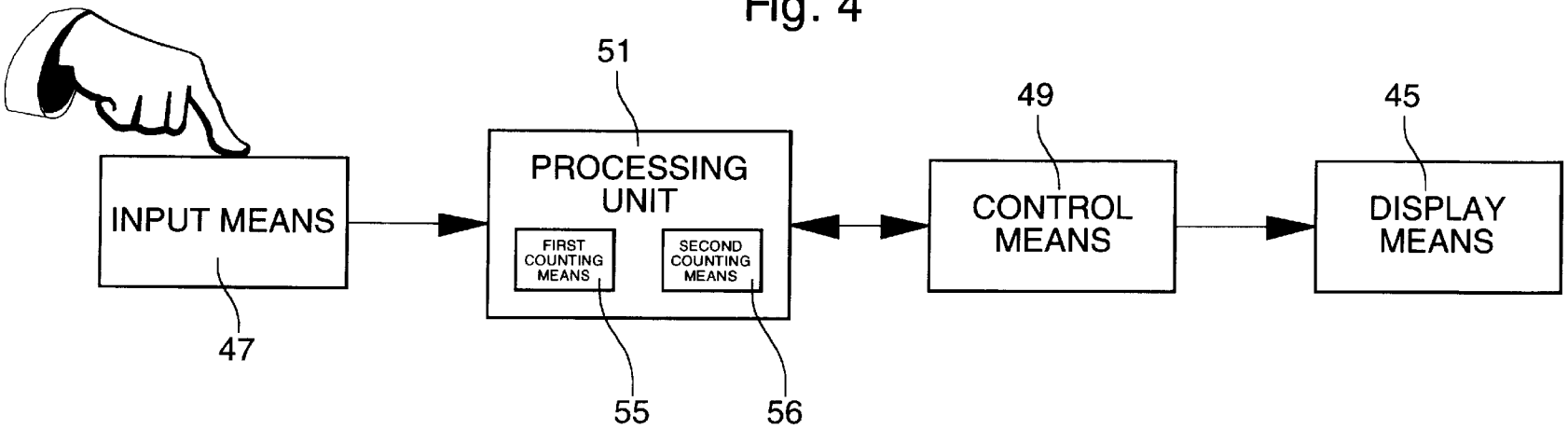
FIG. 4 shows a block diagram of an alternative arrangement of the implementation of FIG. 2.

FIG. 4 shows a block diagram of such an alternative of the implementation of FIG. 2. Thus, the components shown in FIG. 4 designated with the same references as those shown in FIG. 2 are substantially identical to those shown in FIG. 2.

During implementation of the data selection method according to the present invention, the stem-crown is used as input means 47, the dial and the indicators are used as display means 45 and the stepping motor is used as control means 49. It is to be noted that for a stepping motor marketed by Eta SA Fabriques d'Ebauches under the reference CMS 161.578, the time necessary to drive the data display means, representing a step of the motor, is of the order of 15 ms.

Moreover, processing unit 51 is arranged so that it can also store a predetermined duration, and include first and second counting means respectively designated 55 and 56. Within the scope of this horological application, the predetermined number of steps corresponds to the number of steps necessary to achieve a time zone change. Solely by way of example, in the event that a stepping motor of the aforementioned type is used as control means, this number is equal to 180.

First counting means 55 are arranged so that they can count a duration, this duration being set at <<0>> during the initial installation of the timepiece, and as soon as the user stops actuating the input means for a duration greater than the predetermined duration.

Second counting means 56 are connected to the control means, and are arranged so that, following activation of the control means which receive a number of pulses and a scrolling direction, the second counting means can count a number of steps which represents this activation, add this number to a previously counted number of steps, and store the result of such operation as a counted number of steps. In other words, said stored number of steps is an algebraic value whose sign is positive when the scrolling direction is in accordance with the predetermined order, and vice versa, this value being set at <<0>> during the initial installation of the timepiece, and as soon as the duration counted by the first counting means is greater than the predetermined duration.

Figure 5:
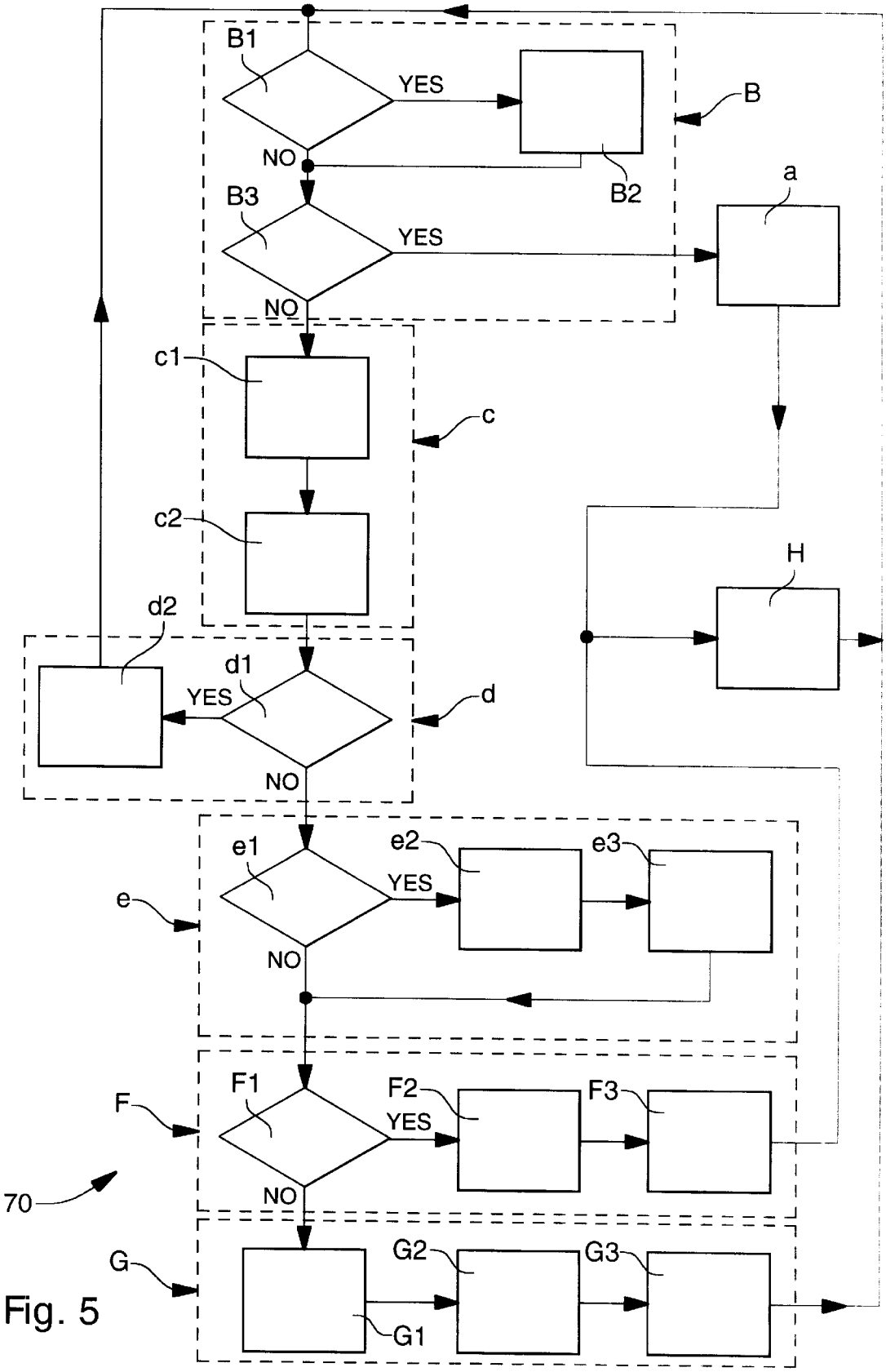
FIG. 5 shows a flow chart of the data selection method implemented in FIG. 4.

FIG. 5 shows a flow chart 70 of the selection method implemented in FIG. 4.

Since the horological application described in relation to FIG. 4 is an alternative arrangement of the implementation of FIG. 2, the same is true of the flow chart of the method implemented in this application. Thus, the steps shown in FIG. 5 and designated by the same references as those shown in FIG. 3 are substantially identical to those shown in FIG. 3.

However, as FIG. 5 shows, step <<a>> is followed by an eighth step designated <<H>> which consists in setting at <<0>> in the first counting means the duration counted by said means.

Moreover, step <<b>> is replaced by a ninth step designated <<B>> which includes three sub-steps respectively designated <<B1>> to <<B3>>. Sub-step <<B1>> consists in testing whether the duration counted by the first counting means is greater than the predetermined duration. Solely by way of example, this predetermined duration is of the order of 1.25 s and considered, by the Applicant of the present invention, as the human response time. If the duration counted by the first counting means is greater than the predetermined duration, sub-step <<B1>> is followed by sub-step <<B2>> which consists in setting the number of steps stored in the second counting means to <<0>>. If the duration counted by the first counting means is not greater than the predetermined duration, sub-step <<B1>> is followed by sub-step <<B3>>. Likewise, sub-step <<B2>> is followed by sub-step <<B3>> which consists in testing whether the control means are being activated. If the control means are being activated, step <<a>>, step <<H>> and step <<B>> are repeated. If the control means are not being activated, sub-step <<B3>> is followed by step <<c>>.

Moreover, step <<f>> is also replaced by a tenth step designated <<F>> which includes three sub-steps respectively designated <<F1>> to <<F3>>. Sub-step <<F1>> consists in testing whether the number of pulses stored in the processing unit is less than the predetermined number of pulses. By way of example only, this predetermined number of pulses is of the order of 5.

If the number of pulses stored in the processing unit is less than the predetermined number of pulses, sub-step <<F1>> is followed by sub-step <<F2>> which consists in supplying the number of pulses stored in the processing unit and the scrolling direction to the control means, in order to drive the display means to display the selected hours and minutes, so that the number of steps effected in accordance with this scrolling direction during this display change corresponds to the number of pulses stored in the processing unit. Sub-step <<F2>> is followed by sub-step <<F3>> which consists in adjusting the number of steps counted following activation of the control means, then step <<H>> and step <<B>> are repeated.

If the number of pulses stored in the processing unit is not less than the predetermined number of pulses, sub-step <<F1>> is followed by step <<g>>.

Moreover, step <<g>> is also replaced by an eleventh step designated <<G>> which includes three sub-steps respectively designated <<G1>>, <<G2>> and <<G3>>. Sub-step <<G1>> consists in subtracting the number of steps counted from the predetermined number of steps. Sub-step <<G1>> is followed by sub-step <<G2>> which consists in supplying the result of this subtraction and the scrolling direction stored in the processing unit to the control means, in order to drive the display means to display a time zone change in accordance with the scrolling direction, while re-establishing the initial minute display i.e. the minute display as soon as the number of steps counted is no longer equal to <<0>>. Sub-step <<G2>> is followed by sub-step <<C3>> which consists in setting at <<0>> the counted number of steps stored in the second counting means, then step <<B>> is repeated.

Solely by way of illustration, three operating modes of a selection method according to the present invention will be described, this method being of the type described in relation to FIGS. 2 and 3.

Figure 6:
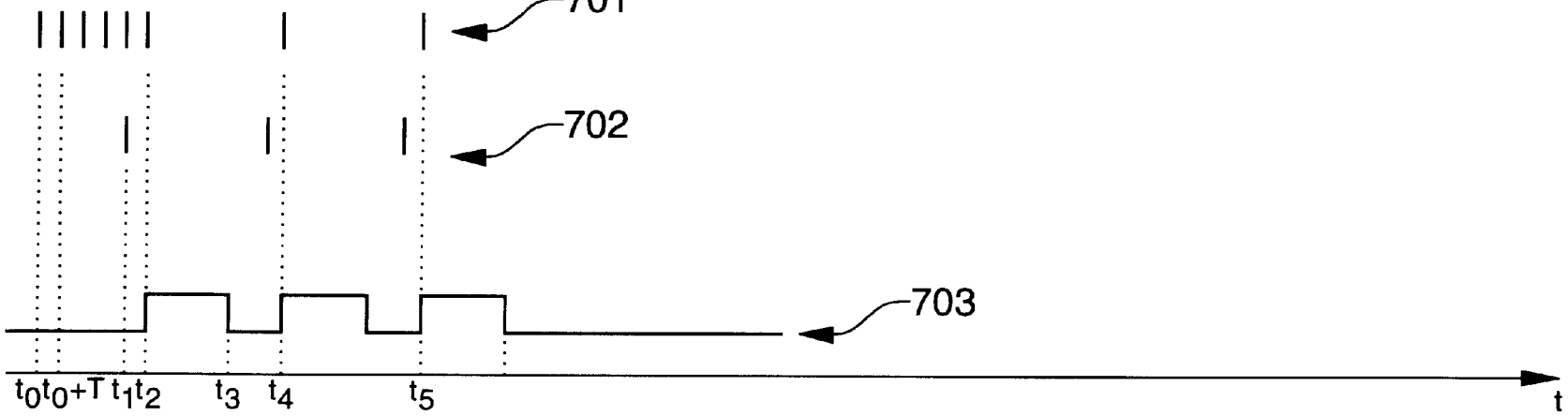
FIG. 6 shows three timing diagrams illustrating a first operating mode of a data selection method according to the present invention, this mode corresponding to zero acceleration during the selection.

FIG. 6 shows three timing diagrams 701 to 703 illustrating a first operating mode of a selection method according to the present invention, this method corresponding to zero acceleration during the selection.

At instant t0, during step <<b>>, control means 49 are not being activated. In other words, no data selection occurs and thus step <<a>> does not occur.

Thus, during step <<c>> which follows, input means 47 are read by processing unit 51. In other words, the number of pulses stored in input means 47 is transferred into processing unit 51, and is stored therein as a number of pulses, and the number of pulses stored in input means 47 is set at <<0>>. By way of example, timing diagram 701 shows the occurrence of such readings, in particular at instant t0. This reading is repeated periodically with a period T, in particular at an instant t0+T.

During step <<d>> which follows, the number of pulses stored in processing unit 51 being equal to "0", the change of direction indicator stored in processing unit 51 is set at <<1>>. In other words, no selection occurs, electronic device 43 can be actuated by a user. Then step <<b>> is repeated, and so on.

At an instant t1, via the action of a user of electronic device 43, input means 47 supply a pulse, and store it as a number of pulses. By way of example, timing diagram 701 shows the occurrence of such pulse supplies, in particular at instant t1.

Consequently, since the control means are not always activated, during step <<c>> which follows, at an instant t2, the number of pulses stored in input means 47 (i.e. in the example of a single pulse) is transferred into processing unit 51, and is stored therein as a number of pulses, and the number of pulses stored in input means 47 is set at <<0>>.

During step <<d>> which follows, the number of pulses stored in processing unit 51 is no longer equal to <<0>>.

During step <<e>> which follows, since the change of direction indicator stored in processing unit 51 is equal to <<1>>, the direction stored in input means 47 is transferred into processing unit 51 and is stored therein as a scrolling direction. Then the change of direction indicator stored in processing unit 51 is set at <<0>>.

During step <<f<< which follows, since the number of pulses stored in processing unit 51 (i.e. <<1>>) is less than the predetermined number of pulses (this number being equal to 5, in this example), the number of pulses and the scrolling direction, stored in processing unit 51, are provided to control means 49, in order to drive the display means to display the selected item of data, so that the number of steps effected in accordance with this scrolling direction during this display change corresponds to the number of pulses stored in the processing unit (i.e. <<1>>).

During step <<b>> which follows, control means 49 are being activated. During step <<a>> which follows, the number of steps provided via the action of the user, is counted during a time period corresponding to the duration of the present activation of the control means, in order to determine the acceleration provided by the user to the input means during this time period. By way of example, timing diagram 703 shows the occurrence of such time periods, in particular that beginning at instant t2 and finishing at instant t3, during which no pulses are provided by the input means. Thus, at instant t3, the situation is similar to that of instant t0 and is repeated.

It will be noted that, during the periods of activation of control means 49, input means 47 are not read by processing unit 51, as timing diagram 701 shows.

It will also be noted that FIG. 6 illustrates an operating mode corresponding to zero acceleration during the data selection. Indeed, during each of the periods of activation of control means 49, these periods beginning at instants t2, t4 and t5, no pulse is supplied by input means 47. In other words, no cumulative effect is observed for the number of pulses stored in input means 47 during the periods of activation of control means 49.

Figure 7:
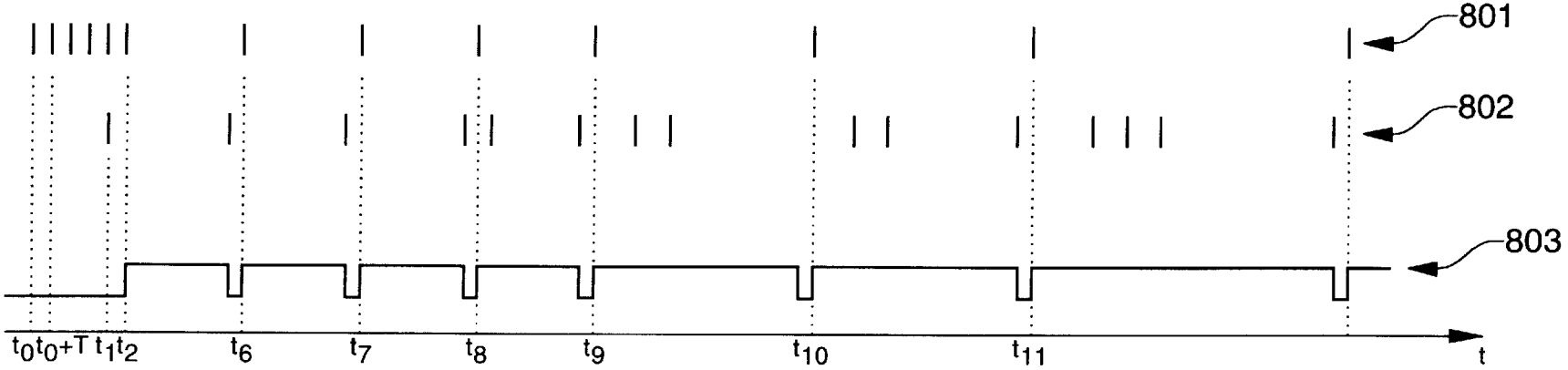
FIG. 7 shows three timing diagrams illustrating a second operating mode of a data selection method according to the present invention, this mode corresponding to small acceleration during the selection.

FIG. 7 shows three timing diagrams 801 to 803 illustrating a second operating mode of a selection method according to the present invention, this mode corresponding to small acceleration during the selection.

By way of example only, timing diagram 801 shows the occurrence of readings of input means 47 by processing unit 51. Likewise, timing diagram 802 shows the occurrence of supplies of a pulse by input means 47, via the action of a user of electronic device 43. Timing diagram 803 shows the occurrence of the time periods corresponding to the duration of the present activation of control means 49.

The initial situation is similar to that of FIG. 6, in particular at instants t0, t0+T, t1 and t2.

Likewise, the situation at instants t6, t7 and t8 is similar to that at instant t2. The number of pulses is equal to <<1>>, during each transfer into processing unit 51, i.e. at instants t6, t7 and t8. However, it is to be noted in each case that this pulse is provided during the period of activation of control means 49, these periods beginning at instants t2, t6 and t7.

Contrary to FIG. 6, a cumulative effect is observed for the number of pulses stored in input means 47 during periods of activation of control means 49. During the period of activation of control means 49, beginning at instant t8, two pulses are provided by input means 47. Thus, the following period of activation which begins at instant t9 is twice as long as the preceding one, which can allow a larger number of pulses to be accumulated during this period. This effect is observed during the period of activation beginning at an instant t10, during which three pulses are supplied. It follows that the following period of activation which begins at an instant t11 is three times as long as the period of activation which begins at instant t8, for example, and so on.

One can thus speak of acceleration during the data selection, or also of a ballistic effect.

Figure 8:
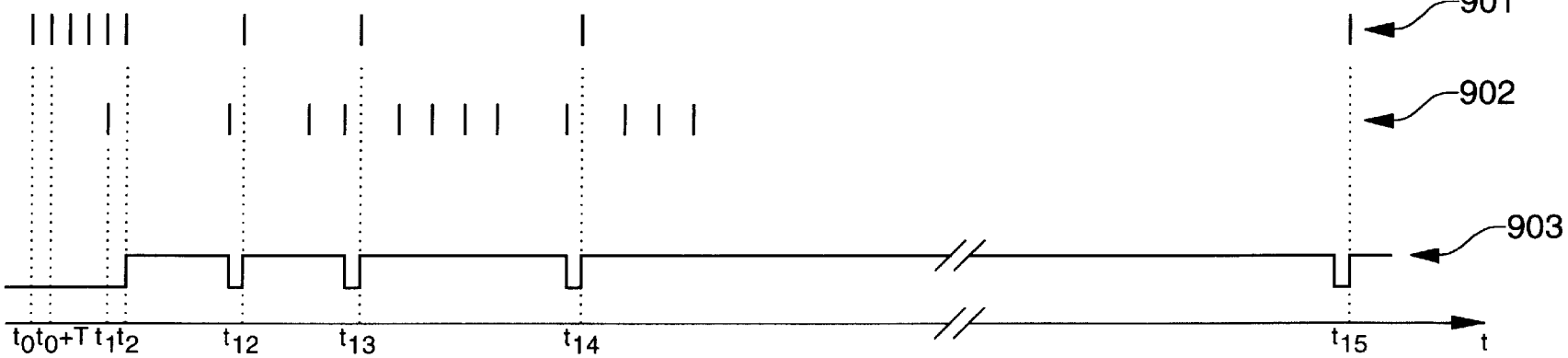
FIG. 8 shows three timing diagrams illustrating a third operating mode of a data selection method according to the present invention, this mode corresponding to substantial acceleration during the selection.

FIG. 8 shows three timing diagrams 901 to 903 illustrating a third operating mode of a selection method according to the present invention, this mode corresponding to substantial acceleration during the selection.

By way of example only, timing diagram 901 shows the occurrence of readings of input means 47 by processing unit 51. Likewise, timing diagram 902 shows the occurrence of supplies of a pulse by input means 47, via the action of a user of electronic device 43. Timing diagram 903 shows the occurrence of the periods corresponding to the duration of the present activation of control means 49.

The initial situation is similar to that of FIG. 6, in particular at instants t0, t0+T, t1 and t2.

Likewise, the situations at instants t12 and t13 are similar, for example, to those respectively at instants t8 and t9 of FIG. 7.

However, it will be noted that, during the period of activation of control means 49, beginning at instant t13, five pulses are provided by input means 47. During step <<f>> which follows, as the number of pulses stored in processing unit 51 (i.e. 5) is not less than the predetermined number of pulses (this number being equal to 5 in this example), step <<f>> is followed by step <<g>>. Thus the predetermined number of steps reduced by the counted number of steps (i.e. 4 in this example) and the scrolling direction stored in processing unit 51 are provided to control means 49, in order to drive the display means to display the first item of data of the sub-set which, according to this scrolling direction, follows the item of data displayed. Then step <<b>> is repeated and, subsequently, the selection method according to the present invention operates according to one of the three operating modes described in relation to FIGS. 6 to 8.

One can thus speak of substantial acceleration during the data selection, with respect to the acceleration described in relation to FIG. 7.

It goes without saying that the different values cited hereinbefore in relation to FIGS. 6 to 8 are given only by way of illustration.

It also goes without saying that the three operating modes described hereinbefore in relation to FIGS. 6 to 8 are capable of being adapted to various implementations of a selection method according to the present invention, in particular to the implementation described in relation to FIGS. 4 and 5.

Those skilled in the art will note that a selection method according to the present invention has the advantage of operating in one of the three operating modes described in relation to FIGS. 6 to 8, these three modes corresponding to three accelerations during the data selection. Those skilled in the art will also note that a selection method according to the present invention has the advantage of being able to pass from one operating mode to another, during a same data selection.

What is claimed is:

1. A method for selecting at least one item of data from a set of data ordered in accordance with a predetermined order and regrouped in sub-sets ordered in accordance with said predetermined order, two successive items of data being separated by a step, this method being able to be implemented in an electronic device (43), in particular a timepiece, this device including:

display means for displaying at least said selected item of data;

input means arranged to provide, via the action of a user of said electronic device, successive pulses and an upward or downward direction, to count the number of pulses supplied and to store this number as a number of pulses received;

a data processing unit arranged to receive said number of pulses received and said direction, and to store a predetermined number of pulses and a predetermined number of steps; and control means for receiving said number of pulses and for controlling said display means in a non-instantaneous manner in which the period of time for displaying said selected item of data is proportional to a number of pulses previously received, wherein said method includes a first step which consists in counting the number of pulses provided during the period of time in which said display means is being activated to reach said selected item of data, and determining the acceleration provided by said user to said input means during this period of time.

2. A method for selecting at least one item of data from a set of data ordered in accordance with a predetermined order and regrouped in sub-sets ordered in accordance with said predetermined order, two successive items of data being separated by a step, this method being able to be implemented in an electronic device (43), in particular a timepiece, this device including:

display means for displaying at least said selected item of data;

input means arranged to provide, via the action of a user of said electronic device, successive pulses and an upward or downward direction, to count the number of pulses supplied and to store this number as a number of pulses received;

a data processing unit arranged to receive said number of pulses received and said direction, and to store a predetermined number of pulses and a predetermined number of steps; and control means for controlling said display means in a non-instantaneous manner, wherein said method includes a first step which consists in counting the number of pulses provided during the period of time in which said display means is being activated to reach said selected item of data, in order to determine the acceleration provided by said user to said input means during this period of time;

wherein said method further includes the following steps:

a second step which consists in: testing whether said control means are being activated; and if said control means are being activated, repeating said first step then said second step;

a third step which consists in: transferring said number of received pulses, said number being stored in said input means, into said processing unit; storing it as a number of pulses; and setting at <<0>> said number of received pulses stored in said input means;

a fourth step which consists in: testing whether said number of pulses stored in said processing unit is equal to <<0>>, setting at <<1>> a change of direction indicator stored in said processing unit, and repeating said second step;

a fifth step which consists in: testing whether said change of direction indicator is equal to <<1>>; and if this indicator is equal to <<1>>, transferring said direction stored in said input means into said processing unit, storing it in said processing unit as a scrolling direction, and setting at <<0>> said change of direction indicator stored in said processing unit;

a sixth step which consists in: testing whether said number of pulses stored in said processing unit is less than said predetermined number of pulses; if said number of pulses stored in said processing unit is less than said predetermined number of pulses, providing said number of pulses stored in said processing unit and said scrolling direction to said control means, in order to drive said display means to display said selected item of data, so that the number of steps effected in accordance with said scrolling direction during this display change corresponds to said number of pulses stored in said processing unit, and repeating said second step; and a seventh step which consists in: providing said predetermined number of steps and said scrolling direction stored in said processing unit to said control means, in order to drive said display means to display the first item of data of the sub-set which, in accordance with said scrolling direction, follows the presently displayed item of data, and repeating said second step.

3. A selection method according to claim 2, wherein said processing unit further includes memory means arranged so that they can receive and store said set of data.

4. A selection method according to claim 3, wherein the data to be selected are surnames associated with alphanumerical data, each of said sub-sets regrouping the totality of the surnames beginning with the same letter, and said predetermined order being that of the alphabet.

5. A selection method according to claim 3, wherein the data to be selected correspond to common nouns associated with meanings, each of said sub-sets regrouping the totality of the nouns beginning with the same letter, and said predetermined order being that of the alphabet.

6. A selection method according to claim 3, wherein the data to be selected correspond to days associated with events, each of said sub-sets corresponding to one of the months of a year, and said predetermined order being that of the passage of time.

7. A selection method according to claim 2, wherein said electronic device is arranged in an analog electronic timepiece.

8. A selection method according to claim 7, wherein the data to be selected correspond to the minutes of an hour, each of said sub-sets corresponding to one of the hours of a day, and said predetermined order being that of the passage of time.

9. A selection method according to claim 8, wherein said processing unit is arranged so that it can also store a predetermined duration, this unit including:

first counting means arranged so that they can count a duration, this duration being set at <<0>> during the initial installation of said timepiece, and as soon as said user stops actuating said input means during a duration greater than said predetermined duration; and second counting means connected to said control means, said second counting means being arranged so that, following an activation of said control means which receive a number of pulses and a scrolling direction, said second counting means can count a number of steps which represents this activation, add this number to a previously counted number of steps, and store the result of this operation as a number of counted steps, this stored number of steps being an algebraic value whose sign is positive when said scrolling direction is in accordance with said predetermined order, and vice versa, this value being set at <<0>> during the initial installation of said timepiece, and as soon as said duration counted by said first counting means is greater than said predetermined value.

10. A selection method according to claim 9, wherein said first step is followed by an eighth step which consists in setting at <<0>>, in said first counting means, said duration counted by these means; and in that said second step is replaced by a ninth step which consists in:

testing whether said duration counted by said first counting means is greater than said predetermined duration; if said duration counted by said first counting means is greater than said predetermined duration, setting at <<0>> said number of steps stored in said second counting means; and testing whether said control means are being activated; if said control means are being activated, repeating said first step, said eighth step and said ninth step.

11. A selection method according to claim 10, wherein said sixth step is replaced by a tenth step which consists in: testing whether said number of pulses stored in said processing unit is less than said predetermined number of pulses; if said number of pulses stored in said processing unit is less than said predetermined number of pulses, providing said number of pulses stored in said processing unit and said scrolling direction to said control means, in order to drive said display means to display the selected hours and minutes, so that the number of steps effected in accordance with this scrolling direction during this display change corresponds to said number of pulses stored in said processing unit; adjusting said number of steps counted following the activation of said control means; and repeating said eighth step and said ninth step; and said seventh step is replaced by an eleventh step which consists in: subtracting said number of steps counted from said predetermined number of steps; providing the result of this subtraction and said scrolling direction stored in said processing unit to said control means, in order to drive said display means to display a change of time zone in accordance with said scrolling direction; while re-establishing the initial minute display which is the minute display as soon as said number of steps counted is no longer equal to <<0>>; setting at <<0>> said number of steps counted in said second counting means; and repeating said ninth step.

12. A method for selecting at least one item of data from a set of data ordered in accordance with a predetermined order and regrouped in sub-sets ordered in accordance with said predetermined order, two successive items of data being separated by a step, said method being able to be implemented in a timepiece (43), wherein the data to be selected correspond to the minutes of an hour, each of said sub-sets corresponding to one of the hours of a day, said predetermined order being that of the passage of time, the timepiece including:

display means for displaying at least said selected item of data;

input means arranged to provide, via the action of a user of said electronic device, successive pulses and an upward or downward direction, to count the number of pulses supplied and to store this number as a number of pulses received;

control means for controlling said display means in a non-instantaneous manner; and a data processing unit arranged to receive said number of pulses received and said direction, and to store a predetermined number of pulses and a predetermined number of steps and also a predetermined duration, said unit further including: first counting means for counting a duration, this duration being set at <<0>> during the initial installation of said timepiece, and as soon as said user stops actuating said input means during a duration greater than said predetermined duration; and second counting means connected to said control means, said second counting means being arranged so that, following an activation of said control means which receive a number of pulses and a scrolling direction, said second counting means can count a number of steps which represents this activation, add this number to a previously counted number of steps, and store the result of this operation as a number of counted steps, this stored number of steps being an algebraic value whose sign is positive when said scrolling direction is in accordance with said predetermined order, and vice versa, this value being set at <<0>> during the initial installation of said timepiece, and as soon as said duration counted by said first counting means is greater than said predetermined value;

wherein said method includes a first step which consists in counting the number of pulses provided during the period of time in which said display means is being activated to reach said selected item of data, and determining the acceleration provided by said user to said input means during this period of time.

13. The selection method according to claim 12, further including the following steps:

a second step which consists in: testing whether said control means are being activated; and if said control means are being activated, repeating said first step then said second step;

a third step which consists in: transferring said number of received pulses, said number being stored in said input means into said processing unit; storing it as a number of pulses; and setting at <<0>> said number of received pulses stored in said input means;

a fourth step which consists in: testing whether said number of pulses stored in said processing unit is equal to <<0>>, setting at <<1>> a change of direction indicator stored in said processing unit, and repeating said second step;

a fifth step which consists in: testing whether said change of direction indicator is equal to <<1>>; and if this indicator is equal to <<1>> transferring said direction stored in said input means into said processing unit, storing it in said processing unit as a scrolling direction, and setting at <<0>> said change of direction indicator stored in said processing unit;

a sixth step which consists in: testing whether said number of pulses stored in said processing unit is less than said predetermined number of pulses; if said number of pulses stored in said processing unit is less than said predetermined number of pulses, providing said number of pulses stored in said processing unit and said scrolling direction to said control means, in order to drive said display means to display said selected item of data, so that the number of steps effected in accordance with said scrolling direction during this display change corresponds to said number of pulses stored in said processing unit, and repeating said second step; and a seventh step which consists in: providing said predetermined number of steps and said scrolling direction stored in said processing unit to said control means, in order to drive said display means to display the first item of data of the sub-set which, in accordance with said scrolling direction, follows the presently displayed item of data, and repeating said second step.

14. The selection method according to claim 13, wherein said first step is followed by an eighth step which consists in setting at <<0>> in said first counting means, said duration counted by these means; and in that said second step is replaced by a ninth step which consists in:

testing whether said duration counted by said first counting means is greater than said predetermined duration; if said duration counted by said first counting means is greater than said predetermined duration, setting at <<0>> said number of steps stored in said second counting means; and testing whether said control means are being activated; if said control means are being activated, repeating said first step, said eighth step and said ninth step.

15. A selection method according to claim 13, wherein said sixth step is replaced by a tenth step which consists in: testing whether said number of pulses stored in said processing unit is less than said predetermined number of pulses; if said number of pulses stored in said processing unit is less than said predetermined number of pulses, providing said number of pulses stored in said processing unit and said scrolling direction to said control means, in order to drive said display means to display the selected hours and minutes, so that the number of steps effected in accordance with this scrolling direction during this display change corresponds to said number of pulses stored in said processing unit; adjusting said number of steps counted following the activation of said control means; and repeating said eighth step and said ninth step; and said seventh step is replaced by an eleventh step which consists in: subtracting said number of steps counted from said predetermined number of steps; providing the result of this subtraction and said scrolling direction stored in said processing unit to said control means, in order to drive said display means to display a change of time zone in accordance with said scrolling direction; while re-establishing the initial minute display which is the minute display as soon as said number of steps counted is no longer equal to <<0>>; setting at <<0>> said number of steps counted in said second counting means; and repeating said ninth step.

* * * * *